United States Patent [19]

Gravemann

[11] Patent Number: 4,883,112

[45] Date of Patent: Nov. 28, 1989

[54] METHOD OF CASTING AND MOLD MAKING

[75] Inventor: Horst Gravemann, Osnabrueck, Fed. Rep. of Germany

[73] Assignee: Kabel-und Metallwerke G. AG, Osnabrueck, Fed. Rep. of Germany

[21] Appl. No.: 229,214

[22] Filed: Aug. 5, 1988

[30] Foreign Application Priority Data

Aug. 5, 1987 [DE] Fed. Rep. of Germany ..... 3725950

[51] Int. Cl.[4] ..... B22D 11/00

[52] U.S. Cl. ..... 164/459; 164/418

[58] Field of Search ..... 164/138, 418, 459, 476, 164/477; 420/469, 494; 148/11.5 C

[56] References Cited

U.S. PATENT DOCUMENTS 2,183,592 7/1938 Silliman ..... 420/469
3,988,176 10/1976 Watanabe et al. ..... 164/418
4,015,982 4/1977 Saito et al. ..... 164/418
4,589,930 5/1986 Kumagai ..... 148/11.5 C
4,787,228 11/1988 Weisner et al. ..... 164/418

*Primary Examiner*—Richard K. Seidel
*Attorney, Agent, or Firm*—Ralf H. Siegemund

[57] ABSTRACT

Continuous casting uses a mold made of copper allow which includes from 0.01% to 0.15% boron, 0.01 to 0.2% magnesium, the remainder being copper as well as manufacture-dependent inpurities and working additives; in addition, at least one additive from the group is used at stated percentages: from 0 to 0.05% silicon, from 0 to 0.5% Ni, from 0 to 0.03% iron, from 0 to 0.03% titanium, from 0 to 0.2% zirconium, from 0 to 0.04% phosphorus, at a total content not exceeding 0.6%, all percentages by weight; the silicon content should be from 0.02% to 0.04%, and the nickel content should be from 0.1 to 0.5%. The mold is made in several working and annealing steps, the last step should be a cold working step with at least 10% deformation.

11 Claims, No Drawings

METHOD OF CASTING AND MOLD MAKING

BACKGROUND OF THE INVENTION

The present invention relates to a method of continuous casting generally and more specifically to the making of a mold using a particular alloy for the mold. More particularly, the invention relates to a method using a mold for continuous casting which includes a specific copper alloy.

Molds for continuous casting of high-melting metal, for example for the continuous casting of steel or steel alloys, have for a long time been copper or copper-based molds, particularly copper of the SF-CU type, wherein SF-CU refers to oxygen-free desoxidized copper of a high degree of purity, see for example ISO Standards R1337, because a mold made of such a material exhibits a sufficiently high thermal conductivity for purposes of very rapidly removing the heat content from the melt. The wall thickness of the mold is usually selected to be sufficiently large so that the mold, in addition to the thermal load, can take up in an adequate manner any and all mechanical loads that may be expected.

In order to increase the hot strength of such a mold, it has been suggested to use an alloy which includes at least 80% copper and at least one additional alloying element which hardens the mold on precipitation. Such alloying element can be chromium, silicon, silver, or beryllium, any of these up to 3%. It was found, however, that molds made of such materials are not fully satisfactory, particularly because alloying components silicon and beryllium reduce the thermo-conductivity of copper to a very high degree (see, for example, Austrian patent No. 234 930).

DESCRIPTION OF THE INVENTION

It is an object of the present invention to provide a new and improved method for a mold for continuous casting of metal, particularly of steel, which mold, in addition to a very high thermal conductivity, is also very high in mechanical strength, particularly as far as hot plasticity is concerned.

In accordance with the preferred embodiment of the present invention, it is therefore suggested to use a copper alloy as material from which to construct a mold for continuous casting which has from 0.01% to 0.15% boron and from 0.01% to 0.2% magnesium in addition to copper as well as manufacture-dependent impurities and usual working additives. Preferably, the boron content is between 0.01 and 0.05% and the magnesium content is between 0.05% and 0.15%. Here and elsewhere in the specifications and claims, all percentages are by weight.

In addition, it is suggested that an alloy comprised basically of material and alloying composition outlined above, include the following components: up to 0.05% silicon, up to 0.5% nickel, up to 0.3% iron, up to 0.3% titanium, up to 0.2% zirconium, and up to 0.04% phosphorus. These components may be individually contained within the respective stated limits, but in a proportion such that the total additive content does not exceed 0.6% by weight.

In order to increase the strength of the copper alloy, it is proposed to use the alloy in a cold-work state, i.e. wherever working of the mold-making material is envisioned, the last treatment step is to be a cold-working step with at least 10% deformation. Previous method steps may include annealing and cold-working alternating with annealing at a lower temperature than was heretofore used, namely, at a temperature between 200 and 450 degrees centigrade. In any event, the last step has to be a coldworking step. This kind of method and treatment increases the strength to a considerable extent.

The mold made in accordance with the invention and upon being used for continuous casting, has a particularly favorable combination of mechanical and physical properties. For example, the thermo-conductivity is 85% of the thermal conductivity for pure copper. Hot strength, creepage strength and hot plasticity are adequate for use in mold working. The Brinnel hardening used to measure abrasion strength, reaches values of up to, and even above, 100 Bh. The mold, when used for continuous casting, has to be very considerably corrosion-proof, and obtains through the copper-magnesium-boron alloy system.

It should be mentioned that the US Patent 2183592 makes known a copper alloy which does have from 0.01% to 0.15% boron to which not more than a total of 0.1% other elements have been added for de-oxidation. In conjunction therewith, magnesium has also been used which, as per this reference, may be included as a ratio of up to 0.05% by weight, It is, pointed out, however, that this particular reference suggests an electrical conductor with a very high electrical conductivity of not less than 85% IACS (International Annealled Copper Standard) and a high resistance against brittleness pure copper in accordance with that standard has an electrical conductivity of 58 meters/ohm.mm$^2$ corresponding to 100% IACS. Any mold for continuous casting is not in the least envisioned or suggested in any manner whatsoever in that reference, nor is there any teaching towards suitability of such an alloy for a mold for continuous casting.

A mold made in accordance with the invention has particularly good physical properties over and beyond the thermo-conductivity. Rather, the mold has properties which are not directly derivable from the state of the art. In the case of continuous casting of steel, the steel alloy engaging the mold has a temperature in excess of 1300 degrees centigrade. Bearing in mind that the melting point of copper, or even of copper alloys, does not greatly exceed 1100° C., it is immediately apparent that the removal of heat from the molten steel is quite critical. In other words, there must be no impediment in the transmission path for heat through the mold wall. In fact, it was found to be sufficient that the mold wall take up a temperature of not much greater than 450 degrees C. The hot strength of the mold i.e. any inevitable deterioration and dropping of the strength has been shifted by the invention into a higher temperature range, being well above the actual operating temperature of the mold during casting. For example, the recrystalization temperature, which is the half-hardness temperature value for an annealing period of half an hour, is between 450 and 540 degrees C., as far as an inventive alloy is concerned. For a constant annealing temperature of 350 degree C., the half-hard annealing time is usually greater than 64 hours.

Another important property of working material for the continuing casting of a mold is its hot plasticity which is determined through a particular area reduction after fracture. A high area reduction after fracture is required in the case of a mold for continuous casting so that the thermal tension does not produce brittleness cracks when the temperature increases. The temperature of the wall increases to values that test the strength.

Another criterion for the mold is its creepage behavior at high temperatures. A small creepage extension of the material is decisive for increasing its use-life, because the requisite dimensional stability of the mold remains for a long period of time. Since molds for continuous casting are usually cooled with water from a side facing away from the molten content, it is also necessary to have a high corrosion resistance as far a contact with water is concerned.

EXAMPLES

Example 1: A copper alloy was used and made of 0.096% magnesium, and 0.032% boron, the remainder being copper, to which certain manufacture-dependent impurities have been added. This alloy 1 was molten in a graphite ladle and in a vacuum and cast as an ingot. Following that, the ingot was extruded into a tube, and after cooling, this tube was reduced as far as cross-section was concerned, by 20%. Following this working, the tube was annealled for five hours at 500 degrees C. In order to obtain some comparative results, three different samples were made from such a tube. A first sample was cold-drawn at a rate of deformation of 10%, the second sample was analogously drawn for a deformation of 20%, and a third sample was analogously deformed and in the same fashion, but by 40%. In each of these instances, the mechanical and electrical properties such as conductivity and recrystallization was investigated.

Tables I, II and III below show in the line "Alloy 1" the requisite measured values. For purposes of comparison, sf-copper as well as a hardened copper-zirconium-chromium alloy was listed as to corresponding properties (second and last lines respectively).

In certain cases of application, it may be of advantage to even lower the high thermo-conductivity or the corresponding electrical thermoconductivity of and in the inventive copper-magnesium boron alloy through certain additives. This lowering may entail from the casting means for reasons of specific casting technology, for example, in instances where the casting in the miniscus area of the mold has to be cooled a little less drastically than is usually deemed necessary. Also, another requirement may be to stir the molten material inductively through the mold wall. In such cases, one many obtain the following results.

For example, the electrical conductivity can be lowered by adding specific amounts of at least one of the elements from among the following. From 0 to 0.05% silicon, from 0. to 0.5% nickel, from 0 to 0.3% iron, from 0 to 0.3% titanium, from 0 to 0.2% zirconium from 0. to 0.04% phosphorus. One can lower the electrical conductivity to values averaging 35 and 52 meter/ ohm mm2 but that do not interfer with the advantageous properties of the basic alloy concerning hardness, recrystalization temperature and creep strength. Owing to the larger proportion of recrystallization impeding boron containing phases in the texture, such alloy composition has in fact a higher annealing strength than a corresponding copper alloy having a lower boron content.

The various columns in Table I show certain cold-working states of the various alloys, as well as average values for the various strength measurements. Here then the tensile strength Rm, the 0.2% repture strength Rp 0.2%, the rupture extension A5, the area reduction on fracture z and the Brinnel hardness B.H.2.5/62.5 are plotted. Another column includes the electrical conductivity in meter per ohm mm2. The recrystallization is represented in the right portion of table 1 through the semi-hard temperature as well as the semi-hardness annealing period.

Tables II and III contain, moveover, measuring results containing concerning creepage extension of the various materials in percentage of a constant load of 15 $N/mm^2$ at a temperature from 200 to 250 degrees C. The various values are plotted with regard to use-times of tubular molds made from the inventive material and being operated for 6, 24, 27, 216, 500,000 and 2000 hours.

Example 2: The basic alloy was made from 0.07% magnesium, 0.5% boron, 0.04% nickel, 0.035% silicon, the remainder being copper, the usual manufacture-dependent impurities. This second alloy was treated and worked just as described above in example 1.

Tables I, II and III again show the technological properites for this example 2, and one shows that specifically that a certain corresponding values are quite the same as in example 1, only the electrical conductivity was dropped from 52.5% to 41.5% meter/ohm $mm^2$.

The various technological values shown in Tables I, II and III demonstrates that alloys 1 and 2 made in accordance with the present invention are far superior as to any relevant properties as far as the comparative or reference material sf-cu is concerned. Table I, moreover, illustrates that the rupture constriction for the alloy is very slightly dependent on the degree of deformation.

Certain properties are slightly lower than those of a referent material being a copper-zirconium alloy. But these properties are not relevant for continuous casting, and moreover, the inventive alloy is more economical, i.e. is cheaper to make than any type of copper-chromium-zirconium alloy.

The invention is, of course, not limited to tubular molds as far as using such a material is concerned. Rather, the material, i.e. the copper material as in the invention, can be used for molds of any kind operating in semi or complete continuous method for continuously casting steel ingots, as well as non-ferrous metal and metal alloy including copper and copper-metal alloy. Thus one can use block molds, casting wheels, cylindrical casting jackets as well as side-walls of double-ribbon casting machines.

The invention is not limited to the examples described above; but all changes and modifications thereof, not constituting genuine departures from the relevant ranges in accordance with the spirit and scope of the invention, are intended to be included.

I claim:

1. A method of continuous casting comprising providing a continuous casting mold of a copper alloy, said copper alloy including from 0.01% to 0.15% boron, and from 0.01 to 0.2% magnesium, the remainder being copper as well as manufacture-dependent impurities and working additives all percentages by weight.

2. Method as in claim 1, the boron content being from 0.01% to 0.05%, and the magnesium content being from 0.05% to 0.15%.

3. Method as in claim 1, including at least one additive from the group and at stated percentages of: from 0 to 0.05% silicon, 0 to 0.5% nickel, from 0 to 0.3% iron, from 0 to 0.3% titanium, from 0 to 0.2% zirconium, from 0 to 0.04% phosphorus, at a total content not exceeding 0.6% all percentages by weight.

4. Method as in claim 3, the silicon content being from 0.02% to 0.04%, the nickel content being from 0.1 to 0.5%.

5. A continuous casting mold comprising a copper alloy which includes from 0.01% to 0.15% boron, and from 0.01 to 0.2% magnesium, the remainder being copper as well as manufacture-dependent impurities and residual working additives, all percentages by weight.

6. A continuous casting mold as in claim 5 wherein said boron content is from 0.01% to 0.05% and said magnesium content is from 0.05% to 0.15%.

7. A continuous casting mold as in claim 5 including in addition, at least one additive from the group and at stated percentages: from 0 to 0.05% silicon, from 0 to 0.5% nickel, from 0 to 0.3% iron, from 0 to 0.3% titanium, from 0 to 0.2% zirconium, from 0 to 0.04% phosphorus, at a total content not exceeding 0.6%.

8. A continuous casting mold, the silicon content being from 0.02% to 0.04%, the nickel content being from 0.1% to 0.5%.

9. A continuous casting mold as in claim 5 wherein said mold is cold-worked by at least 10%.

10. A continuous casting mold as in claim 5 wherein said mold is hot-worked, cold worked at least 10%, annealed at least 15 minutes at a temperature in the range of from 300 to 550 degrees C, followed by at least a 10% cold-working.

11. A continuous casting mold as in claim 10 wherein following the last cold working, another annealing is carried out at a temperature of from 200 to 450 degrees C following which, a final cold working step of at least 10% deformation is carried out.

* * * * *

UNITED STATES PATENT AND TRADEMARK OFFICE
CERTIFICATE OF CORRECTION

PATENT NO. : 4,883,112

DATED : November 28, 1989

INVENTOR(S) : Horst Gravemann

It is certified that error appears in the above-identified patent and that said Letters Patent is hereby corrected as shown below:

Column 4, between lines 54 and 55,
Please insert the following tables, I, II and III as shown on the attached sheets.

Signed and Sealed this

Seventeenth Day of August, 1993

Bruce Lehman

*Attest:*

BRUCE LEHMAN

*Attesting Officer*

*Commissioner of Patents and Trademarks*

Table I

| Examples | Coldworking % | Strength Values $R_m$ N/mm² | $R_{p0.2}$ N/mm² | $A_5$ % | Z % | HB | El.Cond. mΩ mm² | Residence Time at 200° C. in hours | Annealing at 350° C in hours |
|---|---|---|---|---|---|---|---|---|---|
| Referent Material SF-Cu | 25 | 277 | 275 | 17 | | 91 | 47 | ≈ 400 | ≈ 2 - 3 h |
| Alloy 1 | 10 | 273 | 261 | 33.5 | 79 | 85 | 52.5 | 535 | > 64 |
| | 20 | 302 | 289 | 19.0 | 76 | 101 | 52.5 | 490 | > 64 |
| | 40 | 366 | 350 | 13.0 | 72 | 104 | 52.5 | 425 | > 32 |
| Alloy 2 | 10 | 262 | 255 | 31.5 | 75 | 81 | 41.5 | 540 | > 64 |
| | 20 | 320 | 311 | 17.5 | 76 | 103 | 41.5 | 480 | > 64 |
| | 40 | 367 | 356 | 12.5 | 71 | 106 | 41.5 | 425 | > 64 |
| Referent Material CuCrZr | Cure-hardened | 448 | 329 | 27 | 30 | 140 | 49.5 | Softened approx. 500 | |

Table II

| Example | Coldworking % | Use time in hrs. at 200° C 6 | 24 | 72 | 216 | 500 | 1000 | 2000 |
|---|---|---|---|---|---|---|---|---|
| Referent Material SF-Cu | 25 | 0.035 | 0.05 | 0.07 | 0.10 | 0.14 | 0.20 | 0.32 |
| Alloy 1 | 10 | 0.061 | 0.084 | 0.102 | 0.125 | 0.154 | 0.185 | 0.260 |
| | 20 | 0.025 | 0.031 | 0.047 | 0.062 | 0.078 | 0.084 | 0.098 |
| | 40 | 0.023 | 0.029 | 0.037 | 0.055 | 0.070 | 0.080 | 0.094 |
| Alloy 2 | 10 | 0.051 | 0.082 | 0.11 | 0.14 | 0.16 | 0.18 | 0.21 |
| | 20 | 0.025 | 0.035 | 0.045 | 0.061 | 0.084 | 0.098 | 0.11 |
| | 40 | 0.027 | 0.027 | 0.031 | 0.045 | 0.068 | 0.080 | 0.088 |
| Referent Material | Cure-hardened | 0.006 | 0.008 | 0.012 | 0.014 | 0.014 | 0.014 | 0.014 |

Table III

| Example | Coldworking % | Use time in hrs. at 250° C 6 | 24 | 72 | 216 | 500 | 1000 | 2000 |
|---|---|---|---|---|---|---|---|---|
| Referent Material SF-Cu | 25 | 0.11 | 0.31 | 0.58 | 1.27 | 4.57 | (15.3)* | |
| Alloy 1 | 10 | 0.13 | 0.26 | 0.54 | 1.22 | 2.56 | 5.14 | 10.7 |
| | 20 | 0.068 | 0.098 | 0.14 | 0.15 | 0.19 | 0.026 | 0.37 |
| | 40 | 0.049 | 0.068 | 0.12 | 0.13 | 0.15 | 0.17 | 0.23 |
| Alloy 2 | 10 | 0.098 | 0.13 | 0.47 | 0.91 | 1.81 | 3.95 | 11.5 |
| | 20 | 0.045 | 0.066 | 0.096 | 0.14 | 0.19 | 0.22 | 0.29 |
| | 40 | 0.053 | 0.090 | 0.10 | 0.14 | 0.16 | 0.21 | 0.25 |
| Referent Material CuCrZr | Cure-hardened | 0.012 | 0.014 | 0.014 | 0.014 | 0.014 | 0.014 | 0.014 |

*Sample broke after 583 hours